United States Patent [19]

Burnham et al.

[11] 4,384,545

[45] May 24, 1983

[54] DEVELOPMENT SYSTEM

[75] Inventors: Paul W. Burnham; Richard P. Germain, both of Webster, N.Y.

[73] Assignee: Xerox Corporation, Stamford, Conn.

[21] Appl. No.: 63,893

[22] Filed: Aug. 3, 1979

[51] Int. Cl.[3] ..... G03G 15/09

[52] U.S. Cl. ..... 118/651; 118/657; 118/658; 355/3 DD

[58] Field of Search ..... 118/657, 658, 648, 651; 430/122; 222/DIG. 1; 355/3 DD

[56] References Cited

U.S. PATENT DOCUMENTS

| | | | |
|---|---|---|---|
| 3,176,652 | 4/1965 | Mott et al. | 355/3 DD |
| 3,608,522 | 9/1971 | Davidson | 118/658 |
| 3,950,089 | 4/1976 | Fraser et al. | 355/3 DD |
| 4,086,873 | 5/1978 | Morita et al. | 118/658 |

FOREIGN PATENT DOCUMENTS 54-34244 3/1979 Japan .

OTHER PUBLICATIONS

Medley, H. C., *Development of Electrostatic Images, IBM Technical Disclosure Bulletin,* vol. 2, No. 2, Aug. 1959, pp. 4–5.

*Primary Examiner*—Evan K. Lawrence

*Attorney, Agent, or Firm*—H. Fleischer; J. E. Beck; R. Zibelli

[57] ABSTRACT

An apparatus which develops image areas recorded on a surface by transporting a developer material into contact therewith. The apparatus includes a conductive member and an insulating member spaced therefrom. Developer material transported by the conductive member develops the solid regions of the image areas. The insulating member removes developer material from the non-image areas and develops the lines in the image areas with the developer material.

5 Claims, 5 Drawing Figures

DEVELOPMENT SYSTEM

This invention relates generally to an electrophotographic printing machine, and more particularly concerns an apparatus for developing image areas recorded on a photoconductive member.

In general, an electrophotographic printing machine comprises a photoconductive member which is charged to a substantially uniform potential to sensitize the surface thereof. The charged portion of the photoconductive surface is exposed to a light image of an original document being reproduced. This records image areas and non-image areas on the photoconductive member. The image areas, which correspond to the informational areas contained within the original document, are recorded on the photoconductive member, the image areas are developed by bringing a developer mix into contact therewith. This forms a powder image on the photoconductive member which is subsequently transferred to a copy sheet. Finally, the copy sheet is heated to permanently affix the powder image thereto in image configuration.

A suitable developer mix comprises toner particles adhering triboelectrically to carrier granules. Generally, the toner particles are made from a thermoplastic resin with the carrier granules being made from a ferromagnetic material. This two component mixture is brought into contact with the photoconductive surface. The toner particles are attracted from the carrier granules to the image areas and, to some extent to the non-image or background areas. Those particles adhering to the image areas form a powder image on the photoconductive surface. Hereinbefore, it has been difficult to develop both the large solid regions of the image areas and the lines thereof without developing the background. Frequently, solid area development resulted in the background areas attracting the developer mixture thereto. Ultimately, the developer mixture, in this unwanted or background region is transferred to the copy sheet resulting in a degradation of the copy quality. Different techniques have been employed to attempt to improve solid area development without developing the unwanted background regions. For example, a development electrode or screening technique is frequently employed to improve solid area development while preventing development of the background areas which have a lower potential than the solid areas. However, these systems are all rather complex and have suffered from poor development latitutde resulting in low density images being formed on the copy sheets.

Various approaches have been devised to improve development. The following disclosures appear to be relevant.

- U.S. Pat. No. 3,176,652; Patentee: Mott et al; Issued: Apr. 6, 1965.
- U.S. Pat. No. 3,608,522; Patentee: Davidson; Issued: Sept. 28, 1971.
- U.S. Pat. No. 3,950,089; Patentee: Fraser et al.; Issued: Apr. 13, 1976.
- U.S. Pat. No. 4,086,873; Patentee: Morita et al.; Issued: May 2, 1978.
- Japanese Patent Application No. 52-100746; Application Date: Aug. 22, 1977.
- Japanese Laid Open No. 54-34244; Laid Open Date: Mar. 13, 1979; Applicant: Minolta Camera Company, Ltd.

The pertinent portions of the foregoing disclosures may be briefly summarized as follows:

Mott. et al. discloses a developing apparatus comprising an elongated magnet disposed interiorly of a rotatably mounted cylindrical shield. The shield is non-magnetic and may be electrically insulating.

Davidson describes a pair of magnetic rollers. Each magnetic roller comprises an outer cylinder of non-magnetic material with an elongated bar magnet being disposed interiorly of each cylinder.

Fraser et al. discloses a magnetic brush development system having a rotatably driven applicator roll. As shown in FIG. 3, the applicator roll includes a magnet disposed within a conductive sleeve coated or held in intimate contact with a sheet of highly resistive material.

In FIG. 3, Morita et al. shows a magnetic brush development system comprising a conductive cylindrical member having a layer of high insulation material coated thereon. The resistivity of the insulating layer ranges from about $10^8$ to about $10^{15}$ ohms centimeter.

The Japanese patent application discloses a development system including a magnetic roll disposed interiorly of a sleeve. The sleeve is made from a double layered structure with the outer layer being a non-magnetic conductive cylinder and the inner-layer being a non-magnetic insulating member.

In accordance with the present invention, there is provided an apparatus for developing image areas recorded on a surface having image areas and non-image areas thereon. The apparatus includes conductive means for transporting a developer material into contact with the surface to develop the solid areas of the image areas. Insulating means, spaced from the conductive means, transport the developer composition into contact with the surface to remove developer material from the non-image areas and develop the lines of the image areas.

Other aspects of the present invention will become apparent as the following description proceeds and upon reference to the drawings, in which.

While the present invention will hereinafter be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
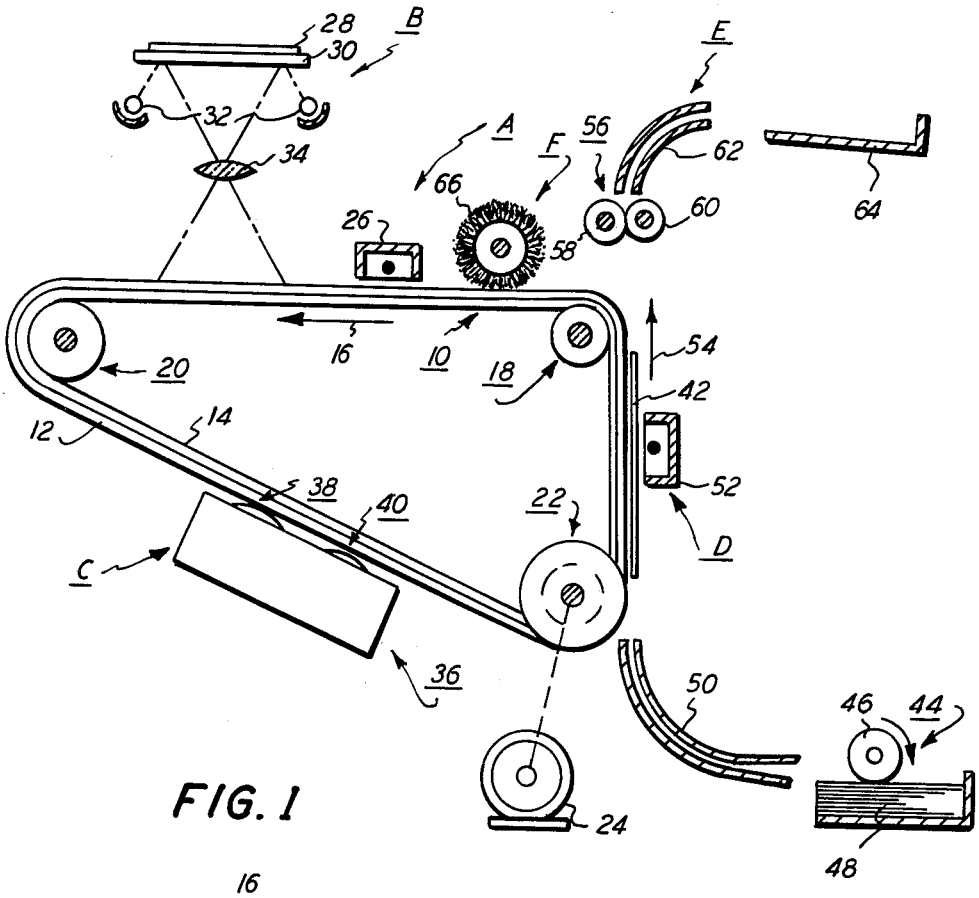
FIG. 1 is a schematic elevational view depicting an electrophotographic printing machine incorporating the features of the present invention therein.

For a general understanding of the features of the present invention, reference is made to the drawings. In the drawings like reference numerals have been used throughout to designate identical elements. FIG. 1 schematically depicts the various components of an illustrative electrophotographic printing machine incorporating the development apparatus of the present invention therein. It will become apparent from the following discussion that this development apparatus is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface 12 deposited on a conductive substrate 14. Preferably, photoconductive surface 12 comprises a transport layer containing small molecules of m-TBD dispersed in a polycarbonate and a generation layer of trigonal selenium. Conductive substrate 14 is made preferably from aluminized Mylar which is electrically grounded. Belt 10 moves in the direction of arrow 16 to advance successive portions of photoconductive surface 12 through the various processing stations disposed about the path of movement thereof. Belt 10 is entrained about stripping roller 18, tension roller 20, and drive roller 22. Drive roller 22 is mounted rotatably and in engagement with belt 10. Roller 22 is coupled to motor 24 by suitable means such as a belt drive. Motor 24 rotates roller 22 to advance belt 10 in the direction of arrow 16. Driver roller 22 includes a pair of opposed spaced edge guides. The edge guides define a space therebetween which determines the desired path of movement for belt 10. Belt 10 is maintained in tension by a pair of springs (not shown) resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records image areas and non-image areas on photoconductive surface 12. The image areas correspond to the informational areas contained within the original document with the non-image areas being unwanted background regions.

Thereafter, belt 10 advances the electrostatic latent image recorded on photoconductive surface 12 to development station C. At development station C, a magnetic brush development system, indicated generally by the reference numeral 36, transports a developer composition of carrier granules and toner particles into contact with photoconductive surface 12. Preferably, magnetic brush development system 36 includes two magnetic brush rollers 38 and 40. These rollers each advance the developer composition into contact with photoconductive surface 12. Each developer roller forms a chainlike array of developer material extending outwardly therefrom. The toner particles are attracted from the carrier granules to the image areas forming a toner powder image on photoconductive surface 12 of belt 10. The detailed structure of magnetic brush development system 36 will be described hereinafter with reference to FIGS. 2 through 5, inclusive.

Belt 10 then advances the toner powder image to transfer station D. At transfer station D, a sheet of support material 42 is moved into contact with the toner powder image. The sheet of support material is advanced to transfer station D by a sheet feeding apparatus 44. Preferably, sheet feeding apparatus 44 includes a feed roll 46 contacting the uppermost sheet of stack 48. Feed roll 46 rotates so as to advance the uppermost sheet from stack 48 into chute 50. Chute 50 directs the advancing sheet of support material into contact with photoconductive surface 12 of belt 10 in a timed sequence so that the toner powder image developed thereon contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly, indicated generally by the reference numeral 56, which permanently affixes the transferred toner powder image to sheet 42. Preferably, fuser assembly 56 includes a heated fuser roller 58 and a back-up roller 60. Sheet 42 passes between fuser roller 58 and back-up roller 60 with the toner powder image contacting fuser roller 58. In this manner, the toner powder image is permanently affixed to sheet 42. After fusing, chute 62 guides the advancing sheet 42 to catch tray 64 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and rotatably mounted fiberous brush 66 in contact with photoconductive surface 12. The pre-clean corona generator neutralizes the charge attracting the particles to the photoconductive surface. The particles are then cleaned from photoconductive surface 12 by the rotation of brush 66 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine.

Figure 2:
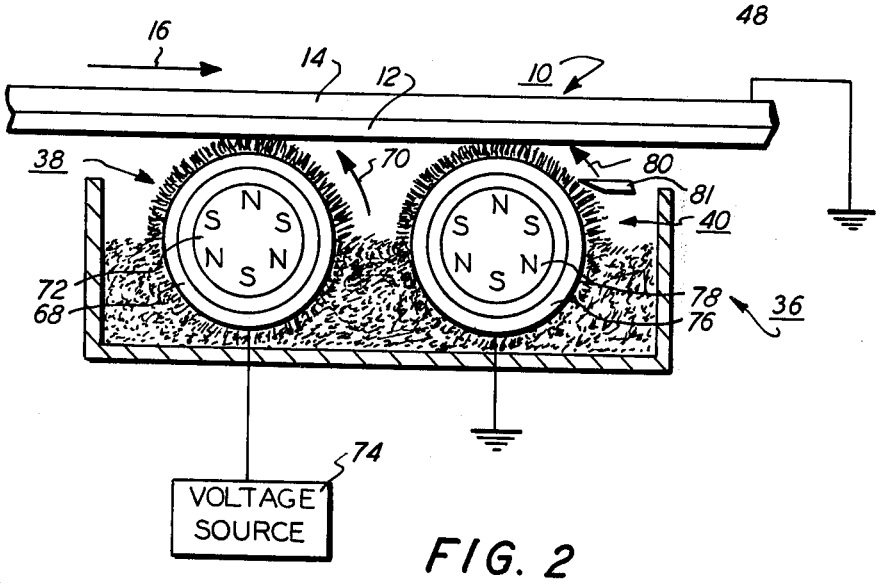
FIG. 2 is a schematic elevational view showing the development system used in the FIG. 1 printing machine.

Referring now to the specific subject matter of the present invention, FIG. 2 depicts development system 36 in greater detail. As depicted thereat, developer roller 38 includes a non-magnetic tubular member 68 journaled for rotation. Preferably, tubular member 68 is made from aluminum having the exterior circumferential surface thereof roughened. Tubular member 68 rotates in the direction of arrow 70. An elongated magnetic rod 72 is positioned concentrically within tubular member 68 being spaced from the interior surface thereof. Magnetic rod 72 has a plurality of magnetic poles impressed thereon. The magnetic field generated by magnetic member 72 attracts the developer mixture to the exterior circumferential surface of tubular member 68. As tubular member 68 rotates in the direction of arrow 70, the developer composition is moved into contact with photoconductive surface 12. The image areas attract the toner particles from the carrier granules to form a powder image. By way of example, magnetic rod 72 is preferably made from barium ferrite. Tubular member 68 is electrically biased by voltage source 74. Voltage source 74 generates a potential having a suitable polarity and magnitude to electrically bias tubular member 68 to the desired level. Preferably, voltage source 74 electrically biases tubular member 68 to a level intermediate that of the background or non-image area voltage level and that of the image area voltage levels. In this manner, the image areas or the electrostatic latent image attracts the toner particles from the carrier granules. However, inasmuch as it is highly desirable to produce good solid area coverage, the voltage level is very close to that of the background areas. By way of example, voltage source 74 electrically biases tubular member 68 with a D.C. voltage ranging from about 150 volts to about 500 volts. The D.C. bias level selected depends upon the background level. Hence, very frequently not only are the solid areas developed but the background areas as well have toner particles and carrier granules deposited thereon. Obviously, it is desirable to remove these background particles while maintaining the solid areas of the image developed. In addition, it is also desirable to develop any lines that may not have been developed heretofore. The foregoing is achieved by developer roller 40.

Developer roller 40 includes a resistive or insulating non-magnetic tubular member 76. This is distinctly different from tubular member 68 which is non-magnetic and conductive. Preferably, tubular member 76 is made from a phenolic resin having a resistivity greater than about $10^9$ ohms-centimeter. Tubular member 76 is electrically grounded. An elongated magnetic rod 78 is positioned concentrically within tubular member 76 being spaced from the interior surface thereof. Magnetic rod 78 has a plurality of magnetic poles impressed thereon. By way of example, magnetic rod 78 is made from barium ferrite. Tubular member 76 rotates in the direction of arrow 80. As tubular member 76 rotates in the direction of arrow 80, a brush of developer mix is formed on the peripheral surface thereof. The brush of developer mix is transported into contact with photoconductive surface 12. Blade 81 has the leading edge thereof closely adjacent to tubular member 76 so as to meter the quantity of developer material being transported thereby. Blade 21 is preferably electrically floating to maximize the insulating behavior of roll 40.

Development of the lines within the image areas is optimized by the insulating nature of developer roll 40. In addition, any residual toner particles or carrier granules adhering to the non-image or background areas are attracted back to tubular member 76. Hence, developer roll 40 acts both to develop the lines within the image areas and to scavenge or clean up the background areas.

Developer compositions that are particularly useful are those that comprise magnetic carrier granules having toner particles adhering thereto triboelectrically. More particularly, the carrier granules include a ferromagnetic core having a thin layer of magnetic overcoated with a non-continuous layer of resinous material. Suitable resins include poly(vinylidene fluoride) and poly(vinylidene fluoride-co-tetrafluoroethylene). The developer composition can be prepared by mixing the carrier granules with the toner particles. Suitable toner particles are prepared by finely grinding a resinous material and mixing it with a coloring material. By way of example, the resinous material may be a vinyl polymer such as polyvinyl chloride, polyvinylidene chloride, polyvinyl acetate, polyvinyl acetals, polyvinyl ether, and polyacrylic. Suitable coloring materials may be, amongst others, chromagen black and solvent black. The developer comprises about 95 to 99% percent by weight of carrier and from about 5 to about 1% weight of toner, respectively. These and other materials are disclosed in U.S. Pat. No. 4,076,857 issued to Kasper et al. in 1978, the relevant portions thereof being hereby incorporated into the present application.

Figure 3:
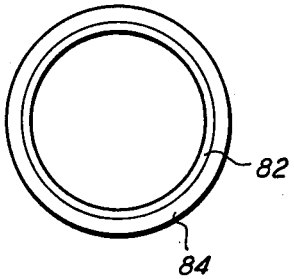
FIG. 3 is a sectional elevational view showing another embodiment of the tubular member of the insulating developer roller used in the FIG. 2 development system.

Turning now to FIG. 3, there is shown another embodiment of tubular member 76. As depicted thereat, tubular member 76 comprises an inner-conductive cylindrical sleeve 82 having a dielectric material 84 coated thereon. By way of example, the dielectric material may be a phenolic resin with conductive sleeve 82 being made from a non-magnetic material, such as aluminum.

Figure 4:
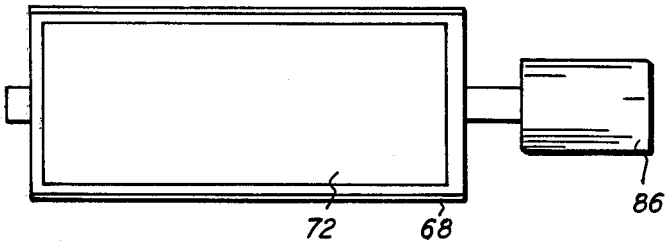
FIG. 4 shows one embodiment of the drive system of the FIG. 2 development system.

Referring now to FIG. 4, there is depicted the preferred drive system for either developer roller 38 or 40. Inasmuch as the drive system is identical for both developer rollers, only the drive system associated with developer roller 38 will be described hereinafter. As shown thereat, a constant speed motor 86 is coupled to tubular member 68. Tubular member 68 is mounted on suitable bearings so as to be rotatable. Magnetic bar 72 is mounted substantially fixed interiorly of tubular member 68. Excitation of motor 86 rotates tubular member 68 in the direction of arrow 70 (FIG. 2). In this way, the developer mixture moves also in the direction of arrow 70, i.e. in the direction opposed to the direction of motion of belt 10, as indicated by arrow 16. Another embodiment of the drive system is depicted in FIG. 5.

Figure 5:
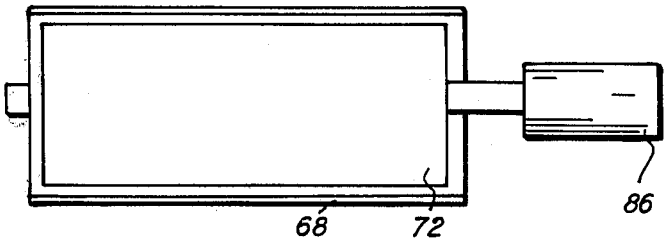
FIG. 5 shows another embodiment of the drive system of the FIG. 2 development system.

Turning now to FIG. 5, there is shown motor 86 coupled to magnetic rod 72. In this embodiment, magnetic rod 72 is journaled on suitable ball bearings for rotation. Tubular member 68 is substantially fixed and remains stationary as magnetic rod 72 rotates. Magnetic rod 72 is arranged to rotate in a direction opposed to arrow 70 (FIG. 2). In this way, the developer composition advances in the direction of arrow 70, i.e. opposed to the direction of movement of belt 10 as indicated by arrow 16.

As previously indicated, either of the embodiments depicted in FIGS. 4 and 5 may be used in developer roll 40 as well as developer roll 38.

In recapitulation, it is evident that the development apparatus of the present invention optimizes solid area and line development by using two developer rollers. One of the developer rollers employs a conductive non-magnetic tubular member for optimizing development of solid areas. The other development roller utilizes an insulating tubular member to optimize line development. In addition, the insulating tubular member attracts thereto any particles adhering to the background areas prior to transfer of the toner powder image to the copy sheet. In this way, copy quality is optimized.

It is, therefore, evident that there has been provided, in accordance with the present invention, an apparatus for developing both the solid areas and lines contained within an image. This apparatus fully satisfies the aims and advantages hereinbefore set forth. While this invention has been described in conjunction with specific embodiments thereof, it is evident that many alternatives, modifications, and varations will be apparent to those skilled in the art. Accordingly, it is intended to embrace all such alternatives, modifications, and variations as fall within the spirit and broad scope of the appended claims.

What is claimed is:

1. An apparatus for developing an electrostatic latent image recorded on a photoconductive surface with a developer material, including:

conductive means having the developer material adhering removably on the exterior surface thereof, said conductive means transporting the developer material into contact with the photoconductive surface so as to optimize development of solid areas within the electrostatic latent image, said conductive means includes a first magnetic member, a rotatable non-magnetic, conductive tubular member having said first magnetic member disposed interiorly thereof, and means for rotating said conductive tubular member relative to said first magnetic member; and insulating means, spaced from said conductive means and having the developer material adhering removably on the exterior surface thereof, said insulating means transporting developer material into contact with the photoconductive surface to develop the lines in the electrostatic latent image.

2. An apparatus as recited in claim 1, wherein said conductive means includes means for electrically biasing said conductive tubular member.

3. An apparatus as recited in claims 1 or 2, wherein said insulating means includes:

a second magnetic member;

a rotatable non-magnetic, insulating tubular member having said second magnetic member disposed interiorly thereof; and means for rotating said insulating tubular member relative to said second magnetic member.

4. An apparatus as recited in claim 3, wherein said insulating tubular member is made from a phenolic resin.

5. An apparatus as recited in claim 3, further including a blade having the leading edge thereof disposed closely adjacent to said insulating tubular member to meter the quantity of developer material being transported thereby, said blade being electrically floating.

* * * * *